United States Patent [19]

Tsujii et al.

[11] 4,070,053

[45] Jan. 24, 1978

[54] SUSPENSION APPARATUS

[75] Inventors: Takehiko Tsujii, Yokohama; Shunsuke Kutsuzawa, Seki, both of Japan

[73] Assignee: Kabushiki Kaisha Nippon Kijuki Seisakusho, Tokyo, Japan

[21] Appl. No.: 729,989

[22] Filed: Oct. 6, 1976

[30] Foreign Application Priority Data

Oct. 7, 1975 Japan ..... 50-136922[U]

[51] Int. Cl.[2] ..... B66C 1/10

[52] U.S. Cl. ..... 294/81 R; 294/83 R; 294/86 R; 294/110 R

[58] Field of Search ..... 294/67 R, 67 DA, 81 R, 294/83 R, 85, 86 R, 110 R

[56] References Cited

U.S. PATENT DOCUMENTS

| | | | |
|---|---|---|---|
| 3,072,430 | 1/1963 | Fahrenwald | 294/83 R |

FOREIGN PATENT DOCUMENTS

| | | | |
|---|---|---|---|
| 185,138 | 8/1922 | United Kingdom | 294/86 R |
| 1,072,721 | 6/1967 | United Kingdom | 294/85 |
| 391,988 | 12/1973 | U.S.S.R. | 294/81 R |

*Primary Examiner*—Johnny D. Cherry
*Attorney, Agent, or Firm*—Holman & Stern

[57] ABSTRACT

A suspension apparatus comprises a pair of movable shackles, and a control unit for automatically engaging or disengaging the movable shackles with or from a hook of a crane as the latter moves first downward and then upward. Each of the movable shackles is pivotally mounted on a beam assembly so as to be rotatable between a reset position in which it is open and a set position in which it is closed with respect to the other movable shackle. The control unit for automatic engagement and disengagement comprises drive apparatus which is supported on the beam assembly between a pair of movable shackles so as to be movable in a vertical direction, the drive apparatus being controlled by an upward and downward movement of the crane hook, connection apparatus for operatively connecting the drive apparatus with the pair of movable shackles, a spring for urging the drive apparatus to its inoperative position for normally maintaining the pair of movable shackles in their reset position, and locking apparatus responsive to an initial downward movement of the crane hook for locking the drive apparatus as it moves the pair of movable shackles to their set position against the resilience of the spring and responsive to a next downward movement of the hook for releasing the drive apparatus.

3 Claims, 10 Drawing Figures

SUSPENSION APPARATUS

FIELD AND BACKGROUND OF THE INVENTION

The invention relates to a suspension apparatus, and more particularly, to a suspension apparatus such as a suspension beam or suspension tong having movable shackles provided therewith which can be automatically engaged with and disengaged from the hook of a crane by a remote control.

The use of a suspension apparatus between the hook of crane and a load is well known in a crane in transporting a load of substantial length and weight such as a roll used in the manufacture of steel. The suspension apparatus has a pair of movable shackles pivotally mounted thereon for suspending the apparatus from the double hook of the crane. An apparatus for automatically engaging or disengaging the movable shackles from the double hook of the crane is also known. For example, Japanese Patent Publication No. 22, 741/1973 issued to Zenichi Kohama et al on July 9, 1973 discloses in FIG. 10 thereof that a pair of movable shackles 1, 2 are normally urged by springs 3, 4 to their reset position in which they are removed or open, but can be rotated toward each other against the resilience of the springs 3, 4 to reach their set position in which they hold the double hook 7 of the crane therebetween, as the double hook 7 is placed on a pair of drive levers 5, 6 which extend from each of the movable shackles toward the other shackle to cause the gravity of the hook to rotate the drive levers 5, 6 about their pivots 8, 9 on the movable shackles 1, 2. The disclosed apparatus includes a locking device 10 which locks the pair of movable shackles 1, 2 when they reach their set position. Subsequently, as the double hook 7 moves upward, the movable shackles 1, 2 can be received in the opening of the hook. The locking device 10 comprises a knock plate 11 which is adapted to be moved by each of the drive levers 5, 6, a pair of locking arms 14, 15 engageable and disengageable from a pair of locking pins 12, 13 secured to the movable shackles 1, 2, and a clutch 16 of a special design which operatively connects the knock plate 11 with the pair of locking arms 14, 15. The movement of the knock plate 11 as the crane hook 7 moves downward initially causes the pair of locking arms 14, 15 to engage the locking pins 12, 13 on the corresponding movable shackles 1, 2, respectively, thus locking the movable shackles 1, 2 in their set position. However, when the crane hook 7 moves upward subsequently and then moves downward, the operation of the knock plate 11 for the second time, (the knock plate 11 being reset by a spring as the crane hook 7 moves upward) causes the pair of locking arms 14, 15 to release the corresponding movable shackles 1, 2 in their position which is the same as their set position.

In the disclosed apparatus, each of the movable shackles 1, 2, as they are released from the locking device 10, is operated upon by the resilience of the springs 3, 4 which causes the shackles to return to their reset position. However, because the crane hook 7 remains in contact with the drive levers 5, 6 secured to the movable shackles 1, 2, the resetting operation takes place only gradually as the crane hook 7 moves upward. The problem then is the fact that an upward movement of the crane hook 7 through an increased stroke is necessary in order to reset the movable shackles 1, 2 from their released position. However, this is undesirable because the likelihood that the crane hook 7 may be inadvertently engaged with the movable shackles 1, 2 during its upward movement increases with an increase in the stroke. This is attributable to the facts that the drive levers 5, 6 on the respective movable shackles 1, 2 must be able to rotate through an angle which is equal to the angle of rotation between the reset position and the set position of the movable shackles 1, 2, and that the drive levers 5, 6 must extend far enough for contact with the crane hook.

SUMMARY OF THE INVENTION

It is an object of the invention to provide a suspension apparatus having a pair of movable shackles which can be controlled to engage with or disengage from a crane hook by a downward and an upward movement of the hook wherein the stroke through which the crane hook must move up and down to operate the movable shackles is minimized.

It is another object of the invention to provide a suspension apparatus having an automatic engagement and disengagement unit which is simple in construction and easily assembled.

According to the invention, the suspension apparatus includes a beam assembly on which a pair of movable shackles are pivotally mounted. Drive means is located between the pair of movable shackles for operating them as the hook of the crane is moved downward and upward, the drive means being supported on the beam assembly so as to be movable in the vertical direction. The drive means is operatively connected with the pair of movable shackles through respective connection means, and the drive means is also connected with spring means which normally maintains the movable shackles in their reset position. The drive means is also provided with key means which cooperates with a locking fixture secured to the beam assembly to form a locking device. The key means may comprise cylindrical cams secured to the drive means, and a key rod having a pin adapted to engage the cylindrical cams, the combination of which constitute together a mechanism which translates a reciprocatory motion into an intermittent rotary motion. Alternatively, the key means may comprise a mechanism which is similar to a manually operated screwdriver.

With the suspension apparatus according to the invention, when the hook of a crane moves down into the space between the pair of movable shackles which normally assume their reset position and load the drive means in its inoperatiave position by the gravity of the hook, the drive means is moved to its maximum operative position against the resilience of the spring means while simultaneously driving the pair of movable shackles through the connection means until they reach their set position in which they hold the stem of the hook therebetween. When the drive means reaches its maximum operative position, the key means mounted thereon cooperates with the locking fixture, with the key rod of the key means engaging the locking fixture to provide a temporary locking. Subsequently, when the crane hook is raised from the drive means, the spring means causes the drive means to return through a small distance to a position, in which it is locked, while the key rod is maintained in engagement with the locking fixture. This operation of the drive means takes place by the engagement of the cylindrical cams with the pin on the key rod, which translates a reciprocatory motion imparted to the drive means to an intermittent rotary motion of the key rod. Thus the key rod rotates through 45° as the drive means initially reaches its maximum operative position, and then rotates through another 45° when the drive means returns to its locked position, whereby the key rod is completely locked with the locking fixture. It is to be noted that during a backward or reverse movement of the drive means from its maximum operative position to its locked position, the connection means between the drive means and the pair of movable shackles is in sliding engagement with the movable shackles to prevent such motion from being transmitted thereto. Hence, once brought to their set position, the pair of movable shackles maintain this position by gravity which they produce in their tilted position unless the drive means is released, and thus is positively engaged with the hook during an upward movement of the crane hook.

When unlocking, the crane hook is placed on the drive means which now assumes its locked position, and as the drive means slightly moves to its maximum operative position again, the key means cooperates with the locking fixture and the key rod further rotates through 45°. Though the key rod remains temporarily locked with the locking fixture in this position, but as the crane hook is raised upwardly of the drive means subsequently, the key rod additionally rotates through 45° while the drive means slightly returns until its locked position is reached, whereby the key rod is completely released from the locking fixture. As a result, both the drive means and the key rod become free and the resilience of the spring means operates through the connection means to return the pair of movable shackles to their reset position as the crane hook moves upward.

The pair of movable shackles is connected through the connection means with the drive means which is moved in the vertical direction, and can be operated through a movement of the drive means through a small stroke, so that the stroke of the upward and downward movement of the crane hook which is required to reset the pair of movable shackles can be minimized. Consequently, the crane hook can be raised smoothly and without interference from between the pair of movable shackles which are retracted to their reset position at an early stage.

DETAILED DESCRIPTION OF PREFERRED EMBODIMENT

Figure 1:
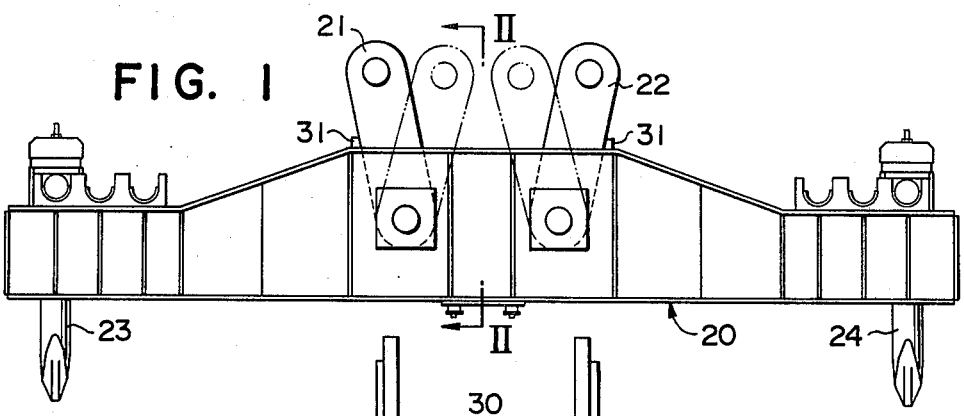
FIG. 1 is a side elevation of the suspension apparatus with automatic engagement and disengagement unit constructed according to the invention.
Figure 2:
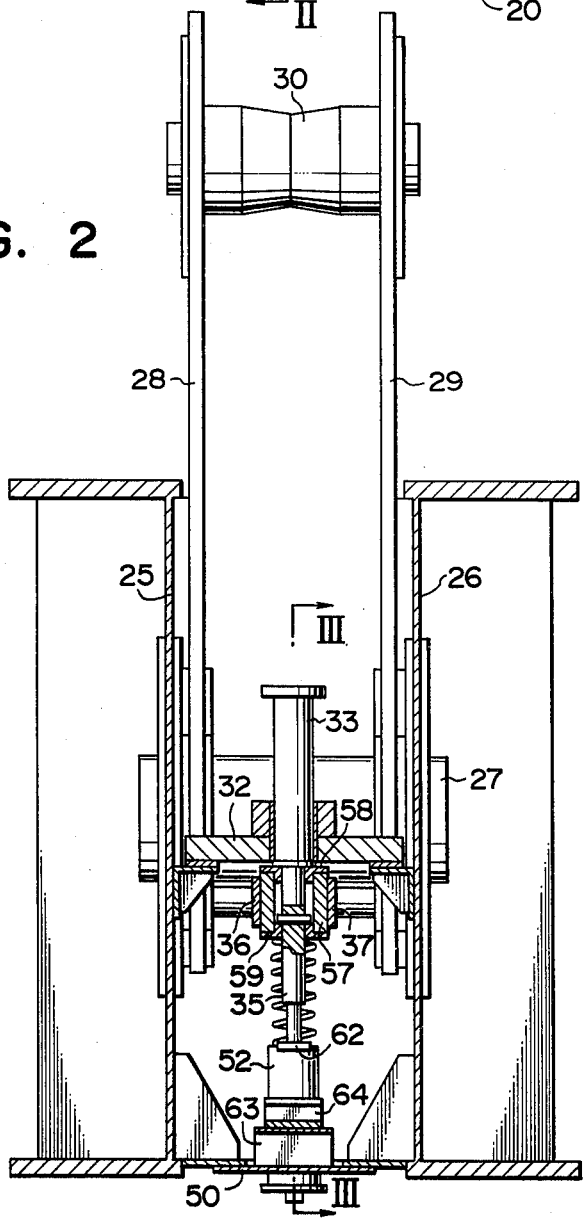
FIG. 2 is an enlarged cross section taken along the line 2—2 shown in FIG. 1.

Referring to FIG. 1, there is shown a suspension apparatus according to the invention which includes a pair of movable shackles 21, 22 and a pair of load hooks 23, 24 generally in a similar manner as a suspension beam of a known form. These shackles and hooks are mounted on a beam assembly 20 which, as shown in FIG. 2, comprises a pair of channel-shaped beams 25, 26, and a plurality of connecting webs, not shown, which interconnect the beams 25, 26 at suitable intervals. Each of the shackles 21, 22 comprises a support shaft 27 secured to and extending between the beams 25, 26, a pair of shackle plates 28, 29 pivotally mounted on the shaft 27, and a shackle bar 30 which is secured to and extends between the free end of the shackle plates 28, 29. The shackles 21, 22 are movable about the shaft 27 between a predetermined reset positon and a set position. In the reset position, the pair of movable shackles 21, 22 are open or removed from each other so that the hook of the crane can move up and down between the shackle bars 30. A pair of stops 31 (FIG. 1) are fixedly mounted on and extend between the beams 25, 26 for defining the reset position of the movable shackles 21, 22. In the set position, the shackles 21, 22 are closed with each other such that the hook of the crane which moves down bears against the shackle bars 30.

Figure 3:
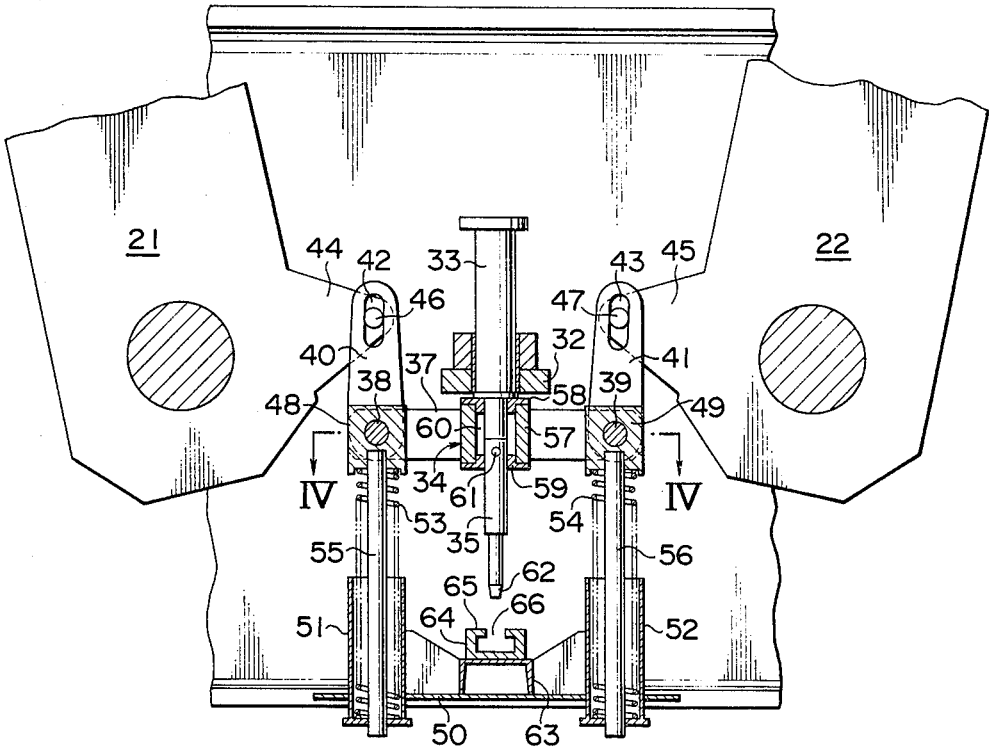
FIG. 3 is a cross section taken along the line 3—3 shown in FIG. 2.
Figure 4:
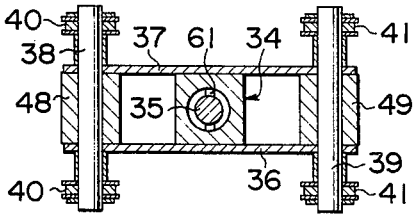
FIG. 4 is a cross section taken along the line 4—4 ahown in FIG. 3.

Referring to FIG. 3, the suspension apparatus according to the invention includes a bearing plate 32 which is secured between the beams 25, 26, and a drive rod 33 is received in the plate 32 so as to be movable in the vertical direction. On its lower portion, the drive rod 33 fixedly carries a key controlling cam unit 34. However, it is to be understood that the drive rod 33 may be disposed only in contact with the unit 34. As will be further described later, the key controlling cam unit 34 is engaged by a key rod 35 which extends coaxially with the drive rod 33. A pair of horizontally extending drive arms 36, 37 are centrally secured to the outside of the cam unit 34 in a rigid manner and carry connecting shafts 38, 39 on their free end (see FIG. 4). Each of the connecting shafts 38, 39 has connecting levers 40, 41 pivotally mounted on their opposite ends, and the connecting levers 40, 41 are formed with grooved slots 42, 43 in their free end for engagement with pins 46, 47 secured to wing portions 44, 45 which extend from the movable shackles 21, 22.

A pair of sleeves 48, 49 are secured to and extend across the opposite ends of the drive arms 36, 37, and surround the connecting shafts 38, 39, these sleeves 48, 49 being loaded by coiled springs 53, 54 which extend from respective spring cases 51, 52 mounted on a bottom plate 50 secured across the beams 25, 26. The sleeves 48, 49 support one end of guide rods 55, 56 extending along the axes of the springs 53, 54, the other end of the rods 55, 56 slidably extending through the spring cases 51, 52. Normally, the both springs 53, 54 urge the drive rod 33 upwardly to its inoperative position through the pair of drive arms 36, 37, and also urge the connecting levers 40, 41 upwardly through the connecting shafts 38, 39 which are supported by the drive arms 36, 37. Under this condition, the pair of movable shackles 21, 22 are tilted to their reset position under their own gravity, and pins 46, 47 associated with the movable shackles loosely engage the grooved slots 42, 43 in the connecting levers 40, 41, respectively, at an intermediate position, but cannot move far enough to allow the individual shackle 21, 22 to tilt toward the other shackle by passing beyond a vertical plane which includes the axis of the associated support shaft 27.

Figure 5:
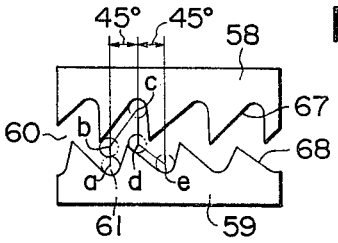
FIG. 5 is a developed view of cylindrical cams shown in FIG. 3.

The key controlling cam unit 34 and the key rod 35 may be constructed as a mechanism of a known form which translates a reciprocatory motion into an intermittent rotary motion, or a mechanism similarly constructed as a manually operated screwdriver. In the example shown, the cam unit 34 comprises a cam casing 57 secured across the pair of drive arms 36, 37, and a pair of upper and lower cylindrical cam pieces 58, 59 which are mounted within the casing 57. As shown in developed view in FIG. 5, the upper and lower cylindrical cam pieces 58, 59 are formed with cam surfaces 67, 68 of a known form, and are spaced by a gap 60, into which extends a pin 61 extending from the key rod 35 which is fitted onto the lower cylindrical cam piece 59. The lower end of the key rod 35 is formed as a T-shaped wedge head 62, which is located opposite to a locking fixture 64 which is secured to a mount 63 located on the bottom plate 50. The locking fixture 64 has a channel-shapedf cross section including an opening 66 with detent lips 65. The wedge head 62 of the key rod 35 is normally oriented so as to be moved into the opening 66 in the locking fixture 60.

Figure 6:
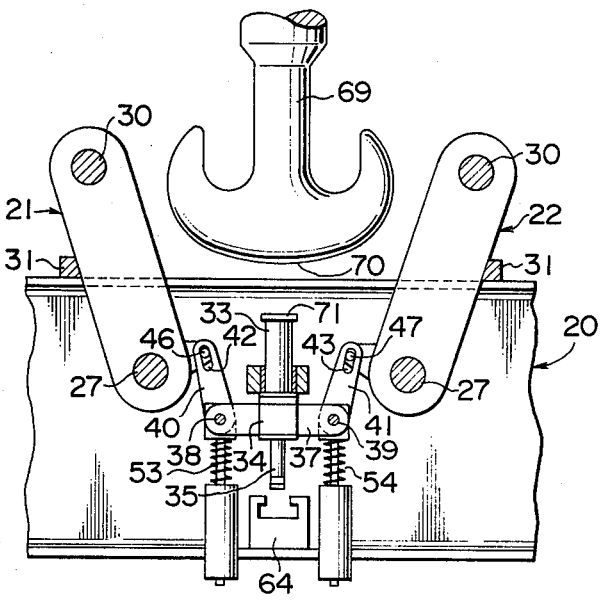
FIG. 6 to 9 are schematic views illustrating different phases of the operation of the automatic engagement and disengagement unit according to the invention.

Referring to FIGS. 6 to 9, the operation of the apparatus will now be described. FIG. 6 shows a normal condition of the suspension apparatus. When the hook 69 of a crane is moved down into the space between the pair of movable shackles 21, 22 which are open in their reset position, the bottom 70 of the hook 69 bears against a flange 71 on the drive rod 33, forcing the drive rod 33 down by gravity, while overcoming the resilience of the springs 53, 54. Thereupon, the drive rod 33 acts through the drive arms 36, 37, connected shafts 38, 39 and connecting levers 40, 41 to rotate the pair of movable shackles 21, 22 about their respective support shaft 27 into the set position shown in FIG. 7. Attention is directed to the position of the pins 46, 47 which engage the grooved slots 42, 43 formed in the connecting levers 40, 41. It will be noted that these pins bear against the lower edge of the slots 42, 43, because upon moving to the opposite side of a vertical plane including the axis of the associated support shaft 27, each of the shackles 21, 22 tilts by itself, under gravity, to its set position.

Figure 7:
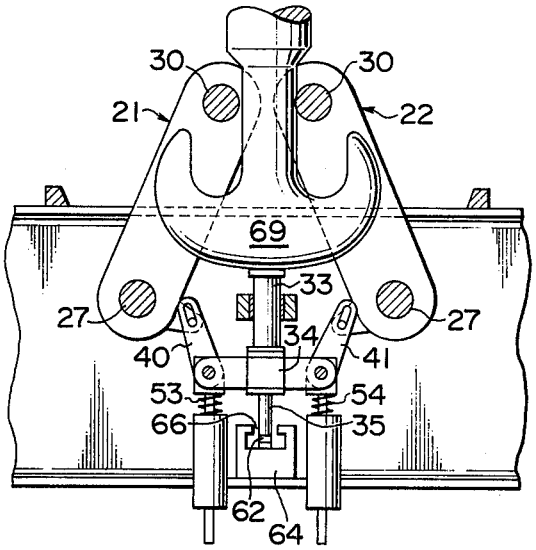
Figure 8:
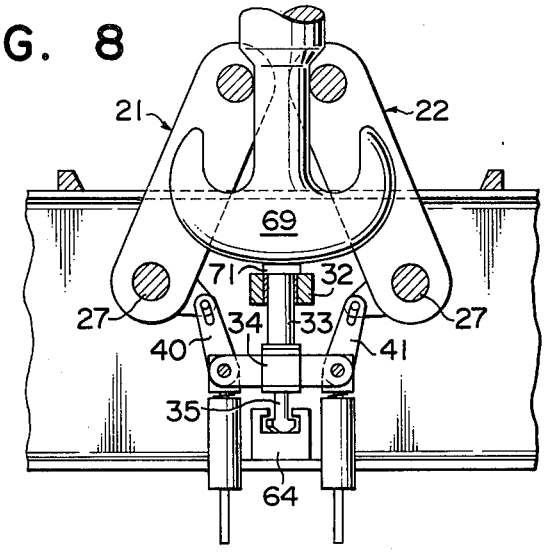

As will be noted in FIG. 7, when the drive rod 33 moves down, the wedge head 62 of the key rod 35 moves into the opening 66 in the locking fixture 64, bearing against it. However, the drive rod 33 has not yet reached its maximum operative position, and continues its downward movement until a position shown in FIG. 8 is reached where the flange 71 of the drive rod 33 bears against the bearing plate 32. During the time the drive rod 33 moves from the position shown in FIG. 7 to the position shown in FIG. 8, the key rod 35 undergoes an angular movement through 45° while its wedge head 62 is being received within the locking fixture 64. This can be understood by reference to FIG. 5 where it will be noted that the pin 61 on the key rod 35 is initially located at a point *a* on the lower cam surface 68, and moves through a point *b* on the upper cam surface 67 to a point *c* as the wedge head 62 of the key rod 35 bears against the locking fixture 64 and the drive head 33 moves down to its maximum operative position. It will be understood that the point *c* is spaced by 45° from the point *a*. An angular movement of the key rod 35 through 45° causes the wedge head 62 to engage the detent lips 65 of the locking fixture 64, thereby providing a temporary locking.

Figure 9:
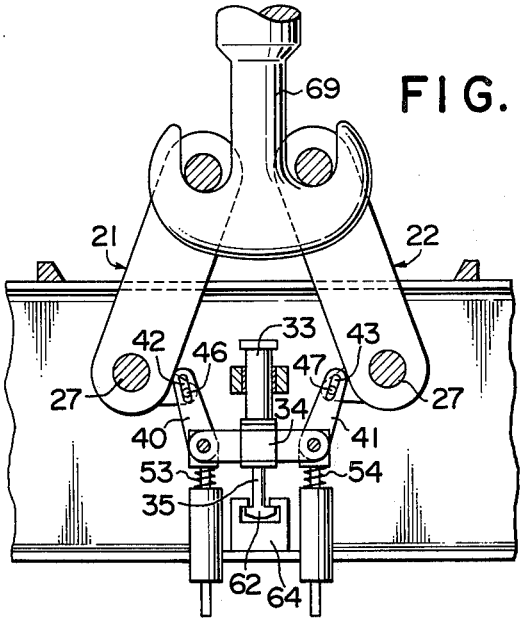
Figure 10:
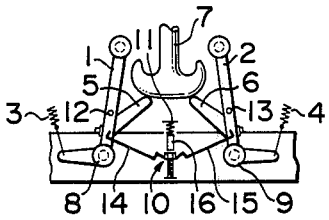
FIG. 10 PRIOR ART
FIG. 10 is a simplified side elevation of a known form of automatic engagement and disengagement unit.

Subsequently when the hook 69 is raised, the drive rod 33 slightly returns to a positive shown in FIG. 9 under the resilience of the springs 53, 54 which is transmitted through the drive arms 36, 37, even though the key rod 35 cannot move axially. During the time the drive rod 33 returns from the position of fig. 8 to the position of FIG. 9, the key rod 35 undergoes an angular movement through another 45°, whereby it is completely locked by the fixture 64. Again referring to FIG. 5, while the pin 61 on the key rod 35 is located at the point *c* on the upper cam surface 67 in the position of FIG. 8, it moves from the point *c* through a point *d* on the lower cam surface 68 to a valley point *e* which is spaced by 45°, as the drive rod 33 is urged upwardly while the wedge head 62 is temporarily locked by the fixture 64. When the pin 61 reaches the point *e*, it cannot move further downward, whereby the drive rod 33 is locked through the cam unit 34. During the time the drive rod 33 slightly returns from the maximum operative position (FIG. 8) to locked position (FIG. 9), the pins 46, 47 associated with the pair of movable shackles 21, 22 maintain a sliding engagement with the grooved slots 42, 43, in the connecting levers 40, 41. As a consequence, the pair of movable shackles 21, 22 maintains their set position even if the hook 69 moves away from the drive rod 33 in an upward direction, thus maintaining their engagement with the hook 69.

When disengaging the shackles 21, 22 from the hook 69, a reverse procedure takes place, the only exception being that the key rod 35 undergoes an angular movement in two increments of 45°, or a total of 90°, without rotating in the reverse direction. When the shackles 21, 22 return from the position of FIG. 7 to the reset position shown in FIG. 6, they are urged by the springs 53, 54 through the connecting levers 40, 41 until they pass through the vertical plane including the axis of the associated support shaft 27, whereupon they move into the reset position by their own gravity.

Having described the invention, what is claimed is:

1. A suspension apparatus including a beam assembly, a pair of movable shackles pivotally mounted on the beam assembly and rotatable between a reset position in which they are removed from each other and a set position in which they close with each other, and a control unit for automatically engaging or disengaged or disengaged the shackles with or from the hook of a crane as the latter moves downward and upward; characterized by the provision of drive means supported on the beam assembly intermediate the pair of movable shackles so as to be movable in the vertical direction, the drive means being controlled between its inoperative and its operative position in response to a downward and an upward movement of the hook, connection means for operatively connecting the drive means with the pair of movable shackles, spring means for urging the drive means to its inoperative position for normally maintaining the pair of movable shackles in their reset position, and locking means for locking the drive means at a locked position intermediate the inoperative and the operative position thereof and for unlocking the drive means at a release position which corresponds to the locked position, an initial downward movement of the hook being effective to drive the drive means from its inoperative to its operative position the resilience of the spring means to thereby drive the pair of movable shackles from their reset to their set position, a subsequent upward movement of the hook being effective to cause the locking means to lock the drive means at the locked position, a following downward movement of the hook being effective to move the drive means from its locked to its operative position, and a next following upward movement of the hook being effective to cause the locking means to unlock the drive means at the release position, thereby allowing the spring means to drive the pair of movable shackles from their set to their reset position.

2. A suspension apparatus according to claim 1 in which the connection means comprises a pair of wing portions formed on each of the pair of movable shackles, pins secured to the wing portions, and connecting levers pivotally mounted on the drive means and including grooved slots formed in their free end for engagement with the pins, the arrangement being such that a sliding engagement is maintained between the connecting levers and the pins during a movement of the drive means from its operative to its locked position.

3. A suspension apparatus according to claim 1 in which the drive means comprises a bearing fixedly mounted on the beam assembly, a drive rod supported by the bearing so as to be movable in the vertical direction, and a drive arm connected with the drive rod, said spring means acting on the drive arm.

* * * * *